United States Patent [19]

Eiswerth

[11] 4,390,320

[45] Jun. 28, 1983

[54] TIP CAP FOR A ROTOR BLADE AND METHOD OF REPLACEMENT

[75] Inventor: James E. Eiswerth, West Chester, Ohio

[73] Assignee: General Electric Company, Cincinnati, Ohio

[21] Appl. No.: 145,412

[22] Filed: May 1, 1980

[51] Int. Cl.[3] ..... F01D 5/18; F01D 5/20

[52] U.S. Cl. ..... 416/97 R; 416/224; 416/228; 415/172 A; 415/174; 29/156.8 B

[58] Field of Search ..... 416/97 R, 224, 228 R; 415/172 A, 174

[56] References Cited

U.S. PATENT DOCUMENTS

| | | | |
|---|---|---|---|
| 3,199,836 | 8/1965 | Moyer | 415/212 R |
| 3,854,842 | 12/1974 | Caudill | 415/116 |
| 3,899,267 | 8/1975 | Dennis et al. | 416/92 |
| 4,169,020 | 9/1979 | Stalker et al. | 204/16 |

FOREIGN PATENT DOCUMENTS

| | | |
|---|---|---|
| 1106261 | 3/1968 | United Kingdom . |
| 1225926 | 3/1971 | United Kingdom . |
| 1423833 | 2/1976 | United Kingdom . |
| 1465282 | 2/1977 | United Kingdom . |
| 1514613 | 4/1977 | United Kingdom . |

*Primary Examiner*—Leonard E. Smith

*Attorney, Agent, or Firm*—Francis L. Conte; Derek P. Lawrence

[57] ABSTRACT

A tip cap for a rotor blade which includes at least one radially extending rib having an abrasive coating thereon for providing a close clearance seal between the rotor blade and the surrounding shroud and also for cleaning the shroud of deposits of material thereon. The tip cap can include a cooling arrangement therein comprising a plurality of cooling passages and a thermal barrier. A method is provided for replacing one tip cap with another and includes the steps of removing a tip cap, machining the end of the rotor blade flat, aligning the replacement tip cap and securing it with the rotor blade.

14 Claims, 5 Drawing Figures

TIP CAP FOR A ROTOR BLADE AND METHOD OF REPLACEMENT

The invention herein described was made in the course of or under a contract, or a subcontract thereunder, with the United States Department of the Air Force.

BACKGROUND OF THE INVENTION

1. Field of the Invention

This invention relates to tip caps for rotor blades, and particularly to a new and improved tip cap which is effective for cleaning the shroud surrounding the rotor assembly as well as for providing a close-clearance seal between the rotor blade and the shroud.

2. Description of the Prior Art

The rotor blades of a rotor assembly in a gas turbine engine are normally surrounded circumferentially by a shroud. The purpose of the shroud is to prevent gas, flowing through the portion of the engine containing the rotor assembly, from bypassing the rotor blades. Without the shroud, the gas could flow outwardly of the radially outer end, or tip, of the rotor blade. The energy of that gas which is prevented from bypassing the rotor blades is utilized to help rotate the rotor assembly. Therefore, engine efficiency increases as the amount of gas bypassing the rotor blades decreases.

To decrease the amount of gas escaping between the tip of a rotor blade and the shroud, the gap between the tip of the rotor blade and the shroud should be minimized as effectively as is practical. One method which is used to minimize the gap is to fabricate the rotor blade to be of such a radial length that the radially outer end, or tip, of the blade is disposed closely enough to the inner surface of the shroud so as to form a seal by itself. Problems can arise when this method is used, however, primarily due to the effects of rubbing. Rubbing is contact between the blade tip and the shroud. Rubbing can be caused by, among other reasons; thermal expansion and contraction of the rotor blades and the shroud, the shroud being not perfectly round, the rotor blades being of different lengths, or deposits of metal or other materials on the shroud or the blade tip.

Rubbing is disadvantageous in that it reduces engine efficiency by converting rotational energy of the rotor assembly into heat resulting from rubbing friction. Rubbing is also disadvantageous in that the tip of the rotor blade is worn away by rubbing. The tip material which is worn away is often deposited on the inner surface of the shroud and, as a result, can eventually cause the other blade tips to rub. Still another disadvantage of rubbing is that the blade tip which rubs is subject to structural fatigue, such as cracking, because of thermal stress due to friction and shear forces due to contact between the blade tip and shroud. Thus, when the tip of a rotor blade is subject to rubbing, the useful life of the blade tip, and thus the engine rotor blade, is shortened. Rubbing, therefore, causes the rotor blade to be replaced sooner than it would be in the absence of rubbing. Blade replacement as a result of wear due to rubbing constitutes a large cost to the user.

One means for reducing the disadvantageous effects of rubbing is the utilization of tip caps on rotor blades. A tip cap is a relatively small extension, having a cross-sectional shape conforming to that of the rotor blade, and which is either integral with or mounted on the radially outer end of the rotor blade. Such a tip cap is also sometimes referred to as a "squeeler tip cap" or a "squealer", but will be referred to simply as a "tip cap" hereinafter. A tip cap which rubs is subject to being worn away and is subject to the same thermal and shear stresses as is a blade tip which rubs. However, if the tip cap can be made to be replaceable, then only the tip cap itself, rather than the entire rotor blade, need be replaced, resulting in a great reduction in cost to the user.

Most tip caps are made of metal. As such, they leave metallic wear deposits on the inner surface of the shroud when they rub. As mentioned earlier, such deposits cause further rubbing to occur. Also, the tip caps become heated due to metal-to-metal friction between the tip cap and the shroud which is also metal. The resultant thermal stresses shorten useful tip cap life by causing fatigue and cracking in the tip cap. Many currently used tip caps include cooling arrangements therein to reduce thermal stresses. However, rotor blades with such tip caps still require relatively frequent replacement or refurbishment because of the inadequacy of the tip cap cooling arrangements and the other aforementioned detrimental effects of rubbing.

The use of a coating of abrasive material on the radially outer edges of a tip cap has been suggested as a partial solution to the above-mentioned problems. For example, such a tip cap is described in U.S. Pat. No. 4,169,020, assigned to the same assignee as the present invention. Although the abrasive material on such a tip cap cleans the inner surface of the shroud of deposits, thereby reducing rubbing and its adverse effects, when the abrasive coating is worn away, the tip cap is effectively transformed into a conventional, non-abrasive tip cap having the associated problems.

In view of the above problems, it is, therefore, a primary object of the present invention to provide a new and improved tip cap for a rotor blade which provides an effective close clearance seal between the tip of the rotor blade and the shroud.

Another object of the present invention is to provide a tip cap with a prolonged useful life for cleaning the inner surface of the shroud of deposits of material caused by rubbing.

Another object of the present invention is to provide a method for replacing a tip cap on a rotor blade.

Yet another object of the present invention is to provide a tip cap which reduces the thermal and shear stresses to the tip cap during rubbing.

Still another object of the present invention is to provide a tip cap having cooling arrangements which prolong useful tip cap life.

SUMMARY OF THE INVENTION

The present invention comprises a tip cap for a rotor blade. The tip cap includes a base portion and at least one rib extending radially outward with an abrasive material secured with the radially outer edge of the rib. The abrasive material rubs and thereby cleans the inner surface of a shroud surrounding the rotor assembly to which the rotor blade is attached, while the tip cap itself provides an effective close-clearance seal between the radially outer end of the rotor blade and the shroud.

In one embodiment of the invention, the tip cap is distinct from the base portion and includes a plurality of ribs sized radially for positioning the abrasive material at varying radial distances from the base portion. This arrangement permits abrasive material on at least one of the ribs to be available for cleaning the shroud even though the abrasive material on a radially taller rib may have been worn away.

The tip cap can include cooling passages angularly disposed in the base portion for impingement cooling of the ribs and can also include a thermal barrier secured with a rib for greater reduction in thermal stress.

A method is provided for replacing one tip cap with another and includes the steps of removing a tip cap from the rotor blade, machining the end of the rotor blade flat, aligning the replacement tip cap, and securing it with the rotor blade.

BRIEF DESCRIPTION OF THE DRAWING

This invention will be better understood from the following description taken in conjunction with the accompanying drawing, wherein.

DESCRIPTION OF THE PREFERRED EMBODIMENT

Figure 1:
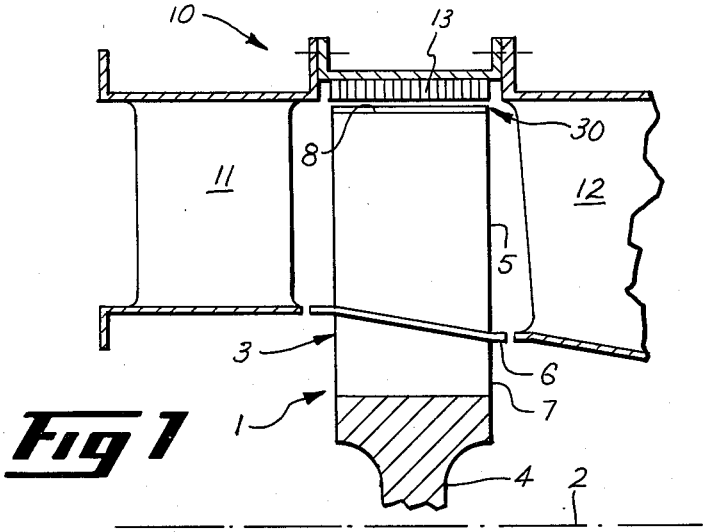
FIG. 1 is a cross-sectional view of a portion of the upper half of a turbine section of a gas turbine engine incorporating the tip cap of the present invention.

Referring now to FIG. 1, there is shown a portion of a turbine engine incorporating one embodiment of the present invention. FIG. 1 shows a portion of the upper half of the turbine section of a typical gas turbine engine. A rotor assembly 1 rotates within the turbine section about the engine longitudinal axis, depicted as the dashed line 2. The rotor assembly 1 comprises a plurality of circumferentially spaced apart rotor blades 3 attached to a generally circular rotor disk 4. Each rotor blade 3 extends radially outward and preferably comprises an airfoil 5, a blade platform 6, a blade shank 7, and a tip, or radially outer end 8.

A stator assembly 10 within the turbine section remains stationary relative to the rotation of the rotor assembly 1. The stator assembly 10 preferably comprises a plurality of circumferentially spaced apart stator vanes 11 located axially upstream of the rotor blades 3. A plurality of circumferentially spaced apart stator vanes 12 can also be located axially downstream of the rotor blade 3. An annular shroud 13 is spaced radially outward of the rotor assembly 1. The radially inner surface of the shroud 13 is preferably located closely adjacent the radially outer end 8 of each blade 3, for reasons to be explained hereinafter.

Gases which flow through the turbine section pass between the stator vanes 11 and are directed by the stator vanes over the airfoil 5 of each rotor blade 3, causing the rotor blades 3, and, therefore, the rotor assembly 1, to rotate. The shroud 13 substantially prevents the gases from radially bypassing the rotor blade 3.

Figure 2:
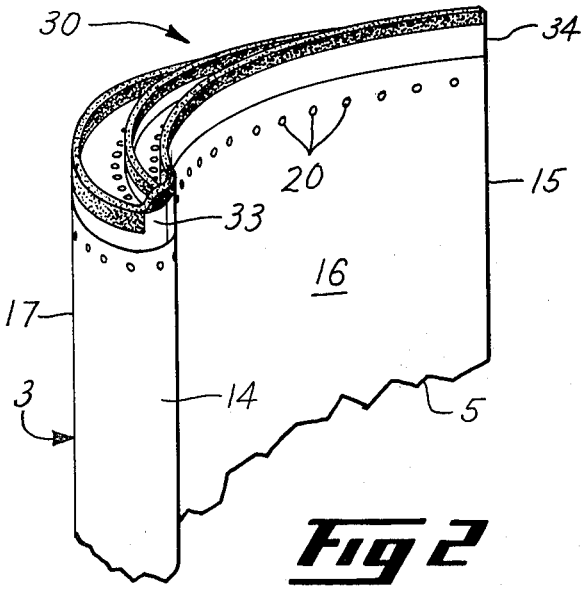
FIG. 2 is a fragmentary perspective view of the radially outer end of a rotor blade incorporating the tip cap of the present invention.

Referring now to FIG. 2, there is shown a radially outer portion of a rotor blade 3, which is preferably the airfoil 5 of the rotor blade. The rotor blade 3 includes a generally upstream edge 14, a generally downstream edge 15 spaced generally axially from the upstream edge, and circumferentially spaced apart sidewalls 16 and 17. Because of the shape and the direction of rotation of the rotor blade 3, the sidewall 16 is the pressure side and the sidewall 17 is the suction side of the blade. The interior of the blade 3 is partially hollow in order to permit air to circulate within the blade to promote cooling. A partially hollow blade also reduces the weight and cost of the blades. Such cooling air can enter the partially hollow interior of the blade 3 in any manner desired, such as, for example, through apertures (not shown) in the blade shank 7.

Figure 3:
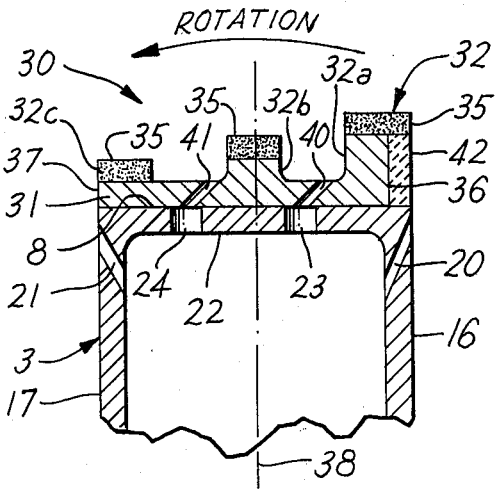
FIG. 3 is a cross-sectional view of the tip cap attached with the outer end of the rotor blade.

As can best be seen in FIG. 3, the sidewalls 16 and 17 can include a plurality of cooling passages 20 and 21, respectively, therethrough, spaced at intervals along the sidewalls from the upstream edge 14 to the downstream edge 15 of the blade 3. The cooling passages 20 and 21 shown in FIG. 3 are arranged at an angle to the sidewall 16 and 17 such that they provide a film of cooling air along the external portions of the sidewalls radially outward of the outer ends of the cooling passages. The cooling passages 20 and 21 can, however, be arranged in any other manner desired.

As also seen in FIG. 3, the blade 3 preferably includes an end wall 22 between the radially outer edges of the sidewalls 16 and 17. The end wall 22 can be secured with the sidewalls 16 and 17 such as by bonding or welding, or it can be integral with the sidewalls, as when the sidewalls and end wall are cast as a single unit. The end wall 22 includes a plurality of cooling passages 23 and 24 arranged in the end wall at intervals between the upstream edge 14 and the downstream edge 15 of the rotor blade 3. The cooling passages 23 and 24 control the amount of cooling air exiting from the interior of the rotor blade at its radially outer end. As such, the cooling passages are preferably sized such that should the tip cap be dislodged from the end of the rotor blade, most of the cooling air is retained within the blade to cool it. If, on the other hand, the cooling passages 23 and 24 were too large or the rotor blade 3 had an open end, upon dislodgement of the tip cap, most of the cooling air would exit the blade resulting in blade overheating and probable damage requiring blade repair or replacement.

Secured with the tip or radially outer end 8 of each rotor blade 3 is a tip cap 30. The tip cap 30 preferably is a distinct tip cap, that is, it is a separate structural element which is attachable to the rotor blade 3. The tip cap 30 provides an effective seal between the radially outer end 8 of the rotor blade 3 and the inner surface of the shroud 13. The tip cap 30 comprises a base portion 31, having a flat radially inner surface which acts as a mounting surface, and at least one rib and preferably a plurality of ribs, generally designated 32. The tip cap is preferably made of a metal, such as, for example, a conventionally cast, directionally solidified, or single grained cobalt base or nickel base superalloy. However, the tip cap 30 can be made of any other suitable material as desired.

Figure 4:
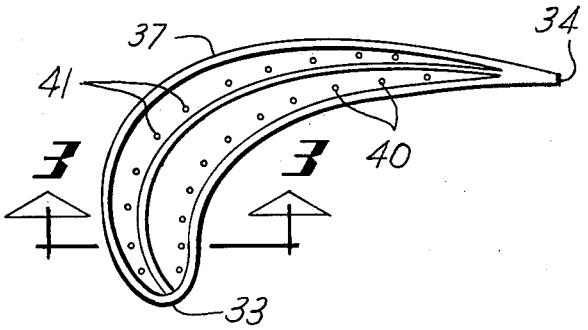
FIG. 4 is a top view of the tip cap of FIG. 3 showing the ribs and the cooling passages.

As seen in FIGS. 3 and 4, the base portion 31 of the tip cap 30 is preferably of a substantially planar airfoil shape and includes a generally upstream edge 33, a generally downstream edge 34, and circumferentially spaced apart side edges 36 and 37. Preferably, the upstream and downstream edges 33 and 34 of the base portion 31 are aligned with the upstream and downstream edges 14 and 15 of the rotor blade 3, respectively, and the side edges 36 and 37 of the base portion 31 are aligned with the sidewalls 16 and 17 of the rotor blade 3, respectively. When so aligned, the side edge 36 of the base portion and the adjacent side of the tip cap are considered the pressure side of the tip cap. Correspondingly, the side edge 37 of the base portion and the adjacent side of the tip cap are considered the suction side of the tip cap.

FIGS. 2, 3, and 4 show an embodiment of the tip cap 30 comprising three ribs—32*a*, 32*b* and 32*c*. However, any desired number of ribs can be utilized. Each rib 32*a*, 32*b*, and 32*c* extends radially outwardly from the base portion 31, has circumferentially spaced apart side surfaces, and preferably each rib extends generally axially from the upstream edge 33 to the downstream edge 34 of the base portion 31. The ribs 32*a* and 32*c* on the outer edges of the tip cap can be integral where they meet at the upstream and downstream edges, as shown in FIGS. 2 and 4.

The radially outer edge of each rib 32*a*, 32*b*, and 32*c* includes an abrasive material 35 secured with it. The abrasive material can be any material suitable for the environment in which it is employed. One example of a suitable abrasive material for use in a turbine of a gas turbine engine is an abrasive alumina coating. The abrasive material 35 can be secured with the rib by any suitable means, such as by coating or plating, for example, of the type used to manufacture metal bonded grinding wheels. Although the abrasive material will hereinafter be referred to as being coated onto the ribs 32, it is to be understood that the term "coating" is intended to include other methods of securing the abrasive material as well.

When the tip cap 30 contacts, or rubs, the inner surface of the shroud 13, it is the abrasive material 35, rather than the metallic, non-abrasive portion of the tip cap, which comes into contact with the shroud. An important advantage of this is that the abrasive material thereby cleans the inner surface of the shroud of any deposits of material on it. Also, because the particles of abrasive material tend to be broken away more easily than would a solid piece of metal, the shear stress transmitted to the tip cap as a whole is less than it would be were the non-abrasive portion of the tip cap to come into contact with the shroud during a rub. Furthermore, because of the tendency of the abrasive particles to be broken away during a rub, the buildup of heat from friction is lower and thus the thermal stress on the tip cap is also lower. Thus, use of the abrasive material 35 on the ribs 32*a*, 32*b*, and 32*c*, prolongs the useful life of the tip cap.

As mentioned earlier, each such rub wears away some of the abrasive material. Therefore, the radially thicker the coating of the abrasive material is, the more rubs it will withstand before it is completely worn away. However, there is a maximum useable thickness limitation to the coating of the abrasive material 35 due to the lack of structural rigidity of the coating compared to the relatively high structural rigidity of the remainder of the tip cap 30. That is, if the abrasive material coating were too thick radially relative to its circumferential dimensions, one rub could cause the entire coating of abrasive material to break off. Of course, the maximum useable radial thickness for the coating of abrasive material 35 is determined by such factors as the circumferential dimensions of the coating and by the properties of the particular abrasive material being used.

The tip cap 30 of the present invention utilizes stepped coatings of abrasive material to achieve a greater effective radial thickness of abrasive material than could be achieved by a single coating thereof. Referring again to FIG. 3, each rib 32*a*, 32*b*, and 32*c* is dimensioned radially such that the coating of abrasive material 35 on the outer end of each rib is at a different radial distance from the base portion 31. The dimensioning is such that abrasive material 35 on at least one of the ribs is positioned in each plane which is perpendicular to the radial axis, generally designated by the dashed line 38, of the rotor blade between the base portion 31 and the radially outer end of the radially tallest rib 32*a*. In this configuration, as the abrasive material 35 on the radially tallest rib 32*a* is worn away due to rubbing with the inner surface of the shroud 13, abrasive material on the next tallest rib 32*b* will be available for rubbing against the shroud. As the abrasive material on each rib is worn away, the abrasive material on the next succeeding shorter rib becomes available for rubbing. If desired, the radially shortest rib 32*c* can consist of abrasive material 35 coated directly onto the surface of the base portion 31. Of course, when the abrasive material 35 on any particular rib 32 is worn away, the remaining non-abrasive portion of that rib will continue to be worn away by rubbing at the same rate that the abrasive material on the next shorter ribs rubs the inner surface of the shroud 13. However, any material deposited on the inner surface of the shroud 13 by such rubs of the non-abrasive portion of a rib will be cleaned by the rubbing of abrasive material on a rib of the same tip cap or of the tip cap of another rotor blade.

As can be seen in FIG. 3, the radially tallest rib 32*a* is adjacent the side edge 36 and the radially shortest rib 32*c* is adjacent the side edge 37 of the base portion 31. The ribs 32 can be arranged in any other desired manner, however.

The tip cap 30 should be cooled in order to reduce thermal stress within it and therefore to prolong its useful life. Cooling of the tip cap 30 is accomplished in several ways. The side edges 36 and 37 of the tip cap are film cooled by air exiting the cooling passages 20 and 21 and flowing radially outward along the sides of the tip cap. The base portion 31 of the tip cap 30 includes a plurality of cooling passages 40 and 41 which are spaced at intervals along the base portion 31 and are aligned with the cooling passages 23 and 24, respectively, in the end wall 22 of the rotor blade 3. Air exiting the cooling passages 40 and 41 cool the side surfaces of the ribs 32*a* and 32*b* impingement. The number and arrangement of cooling passages 40 and 41 can be as desired. For effective cooling of the ribs 32*a* and 32*b*, however, it is preferable that the cooling passages 40 and 41 be angularly disposed, that is, inclined at an angle, such as that shown in FIG. 3, whereby air exiting the cooling passages impinges upon a radially inner portion of the side surfaces of the ribs. After impinging upon the ribs, that air then becomes a film of cooling air along the radially outer portions of the side surfaces of the ribs. The cooling passages 40 and 41 are preferably drilled through the base portion 31, and in order to drill them at an angle whereby they are aimed at the radially inner portions of the ribs 32, such drilling would best be accomplished from the radially inner face, or underside, of the base portion 31. Therefore, it is preferable that the tip cap 30 be prefabricated separately from the rotor blade 3 and the cooling passages 40 and 41 drilled prior to attaching the tip cap 30 with the end of the rotor blade 3.

The tip cap 30 can include at least one thermal barrier secured with a rib 32, such as the thermal barrier 42 shown secured with the pressure side surface of the rib 32*a* and the side edge 36 of the base portion 31 in FIG. 3. A thermal barrier 42 aids in preventing overheating of the rib to which it is attached, and thus aids in reducing thermal stress in the tip cap 30. A thermal barrier is particularly useful on the radially taller ribs where film cooling or impingement cooling of the ribs may be insufficient. One example of such a thermal barrier is a ceramic coating, such as zirconia, sprayed onto the rib.

As indicated earlier, it is preferable that the tip cap 30 be prefebricated separately from the rotor blade 3 in order that cooling passages can be drilled at an appropriate angle therethrough. The tip cap 30, and more specifically the base portion 31 of the tip cap, is then secured or attached with the rotor blade 3 across the radially outer end 8, which in FIG. 3 comprises the outer surface of the end wall 22, by appropriate means, such as, for example, by diffusion bonding or brazing. Alternately, the tip cap 30 can be attached with a rotor blade which has an open radial end, that is, one which does not include an end wall 22, by securing it across the radially outer edges of the sidewalls 16 and 17 of the rotor blade 3.

Figure 5:
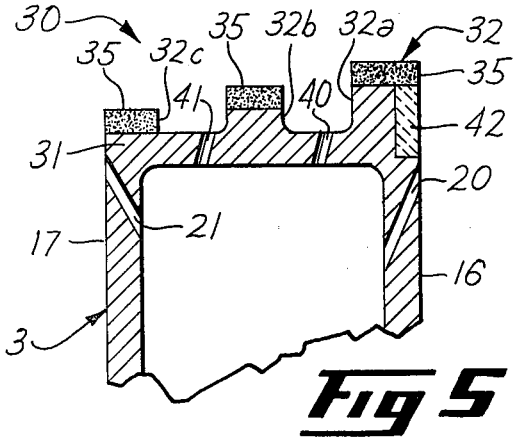
FIG. 5 is a cross-sectional view of the tip cap integral with the rotor blade.

In either of the above arrangements, the tip cap 30 is preferably made to be distinct from the rotor blade and thereby is replaceable without having to replace the rotor blade 3. However, if desired, and as can be seen in FIG. 5 the tip cap 30 can also be made integral with the rotor blade 3, such as by coating it as one piece with the rotor blade. In this arrangement, the base portion 31 extends across the sidewalls 16 and 17 of the rotor blade and the ribs 32 extend radially outwardly from the base portion. The cooling passages 40 and 41 communicate directly with the interior of the rotor blade 3.

A preferred method for replacing a first tip cap with a second tip cap is as follows:

remove the first tip cap by appropriate means, such as by cutting or grinding it away; machine the radially outer end 8, which includes the ends of the sidewalls 16 and 17 and the outer face of the end wall 22 if incorporated, of the rotor blade 3 to a flat surface; align the second tip cap with the rotor blade 3, ensuring that the cooling passages 23 and 24 are in alignment with the cooling passages 40 and 41; and secure the radially inner surface, or mounting surface, of the second tip cap with the radially outer end 8 of the rotor blade, by appropriate means, such as by diffusion processing or brazing. This method of replacing a tip cap is less costly and less time consuming then previous methods of refabricating tip caps on the ends of rotor blades.

It is to be understood that this invention is not limited to the particular embodiment disclosed, and it is intended to cover all modifications coming within the true spirit and scope of this invention as claimed.

What is claimed is:

1. In a rotor blade including generally circumferentially spaced apart sidewalls, a tip cap positioned at a radially outer end of and integral with said rotor blade comprising:

(a) a base portion extending across said sidewalls; and (b) a plurality of ribs extending radially outward from said base portion, including abrasive material secured with the radially outer edges thereof, and sized radially for positioning said abrasive material at varying radial distances from said base portion and beyond said radially outer end of said rotor blade such that abrasive material on said ribs is positioned in each plane perpendicular to the radial axis of said rotor blade between said base portion and the radially outer end of the radially tallest rib for providing said tip cap with stepped coatings of abrasive material such that as said abrasive material on each of said plurality of said ribs is worn away, said abrasive material on a next succeeding radially shorter rib becomes available for rubbing.

2. A method for replacing a first tip cap with a second tip cap on a radially outer end of a rotor blade, wherein said first and second tip caps each comprise a base portion for attachment with said rotor blade across said radially outer end and a plurality of ribs each extending radially outward from said base portion and including an abrasive material secured with a radially outer edge thereof, said ribs being dimensioned radially for positioning said abrasive material at varying radial distances from said base portion and beyond said radially outer end of said rotor blade for providing said tip cap with stepped coatings of abrasive material such that as said abrasive material on each of said plurality of ribs is worn away, said abrasive material on a next succeeding radially shorter rib becomes available for rubbing, comprising the steps of:

(a) removing said first tip cap;

(b) machining said radially outer end of said rotor blade to a flat surface;

(c) aligning said second tip cap with said rotor blade; and (d) securing said mounting surface of said second tip cap with said radially outer end of said rotor blade.

3. The method of claim 2 wherein the securing of said mounting surface of said second tip cap with said radially outer end of said rotor blade is accomplished by diffusion processing.

4. In a radially extending rotor blade including generally axially spaced apart upstream and downstream edges, circumferentially spaced apart sidewalls, and a radially outer end, a distinct tip cap for said rotor blade comprising:

(a) a base portion being of substantially planar airfoil shape, secured with said rotor blade across said radially outer end, and having upstream and downstream edges aligned with said upstream and downstream edges of said rotor blade; and (b) a plurality of ribs extending generally axially from said upstream edge toward said downstream edge of said base portion, each said rib extending radially outwardly from said base portion and including an abrasive material secured with a radially outer edge thereof, said ribs being sized radially for positioning said abrasive material at varying radial distances from said base portion and beyond said radially outer end of said rotor blade for providing said tip cap with stepped coatings of abrasive material such that as said abrasive material on each of said plurality of ribs is worn away, said abrasive material on a next succeeding radially shorter rib becomes available for rubbing.

5. The tip cap of claim 4 wherein abrasive material on said ribs is positioned in each plane perpendicular to the radial axis of said rotar blade between said base portion of said tip cap and the radially outer edge of the radially tallest rib.

6. In a radially extending rotor blade including generally axially spaced apart upstream and downstream edges, circumferentially spaced apart sidewalls defining a partially hollow interior therebetween and having a plurality of cooling passages therethrough near the radially outer ends thereof, and an end wall between the radially outer edges of said sidewalls and having a plurality of cooling passages therethrough, a distinct tip cap for said rotor blade comprising:

(a) a base portion being of substantially planar airfoil shape, secured with said end wall, and having upstream and downstream edges and circumferentially spaced apart side edges aligned with said upstream and downstream edges and said circumferentially spaced apart sidewalls respectively of said rotor blade and having a plurality of cooling passages therethrough aligned with said cooling passages in said end wall for directing fluid from the interior of said rotor blade onto at least one rib; and (b) a plurality of ribs extending generally axially from said upstream edge to said downstream edge of said base portion, each said rib including an abrasive material secured with the radially outer end thereof, said ribs being dimensioned radially for positioning said abrasive material at varying radial distances from said base portion such that abrasive material on at least one of said ribs is positioned in each plane perpendicular to the radial axis of said rotor blade between said base portion of said tip can and the radially outer end of the radially tallest rib.

7. The tip cap of claim 6 further comprising a thermally insulative material secured with a side of at least one of said ribs.

8. The tip cap of claim 6 wherein said tip cap comprises three ribs, the radially tallest and shortest of said ribs each being adjacent a circumferentially spaced apart side edge of said base portion.

9. A tip cap for a rotor blade including a radially outer end comprising a base portion for attachment with said rotor blade across said radially outer end and a plurality of ribs each extending radially outward from said base portion and including an abrasive material secured with a radially outer edge thereof, said ribs being dimensioned radially for positioning said abrasive material at varying radial distances from said base portion and beyond said radially outer end of said rotor blade for providing said tip cap with stepped coatings of abrasive material such that as said abrasive material on each of said plurality of ribs is worn away, said abrasive material on a next succeeding radially shorter rib becomes available for rubbing.

10. The tip cap of claim 9 wherein said base portion is substantially airfoil shaped and comprises upstream and downstream edges and said ribs extend generally axially from said upstream toward said downstream edges of said base portion.

11. The tip cap of claim 9 wherein said plurality of ribs are spaced circumferentially apart on said base portion.

12. The tip cap of claim 9 wherein said base portion has a plurality of cooling passages angularly disposed therethrough for directing impingement cooling air against one side surface of at least one of said ribs, said at least one of said ribs having a thermally insulative material secured with the other side surface thereof.

13. The tip cap of claim 9 further comprising a thermally insulative material secured with a side of at least one of said ribs.

14. The tip cap of claim 13 wherein said tip cap includes a pressure side, a suction side, and a rib disposed adjacent said pressure side, and said thermally insulative material is secured with the pressure side of said rib.

* * * * *